US008539619B2

(12) United States Patent
Mardirossian

(10) Patent No.: US 8,539,619 B2
(45) Date of Patent: Sep. 24, 2013

(54) CLEANING SYSTEMS AND/OR METHODS

(75) Inventor: Aris Mardirossian, Potomac, MD (US)

(73) Assignee: Technology Patents, LLC, Potomac, MD (US)

( * ) Notice: Subject to any disclaimer, the term of this patent is extended or adjusted under 35 U.S.C. 154(b) by 701 days.

(21) Appl. No.: 12/585,405

(22) Filed: Sep. 14, 2009

(65) Prior Publication Data

US 2011/0061159 A1 Mar. 17, 2011

(51) Int. Cl.
*A47K 3/00* (2006.01)

(52) U.S. Cl.
USPC ..... 4/611; 4/615

(58) Field of Classification Search
USPC ..... 4/611, 602, 603, 560.1, 567, 578, 4/579, 615; 401/156, 183, 184, 265
See application file for complete search history.

(56) References Cited

U.S. PATENT DOCUMENTS

| | | | | | |
|---|---|---|---|---|---|
| 3,574,239 | A | * | 4/1971 | Sollerud | 4/616 |
| 3,913,839 | A | * | 10/1975 | Wilson | 239/267 |
| 4,425,672 | A | * | 1/1984 | Johnson et al. | 4/596 |
| 4,974,268 | A | | 12/1990 | Cors et al. | |
| 4,998,305 | A | | 3/1991 | Davis | |
| 5,329,651 | A | * | 7/1994 | Mardero et al. | 4/605 |
| 5,465,437 | A | | 11/1995 | Herman | |
| 5,590,427 | A | * | 1/1997 | Weterings et al. | 4/611 |
| 5,953,770 | A | | 9/1999 | Kitamura | |
| 5,996,140 | A | | 12/1999 | Kitamura | |
| 6,042,178 | A | * | 3/2000 | Hetherington | 297/14 |
| 6,098,214 | A | * | 8/2000 | Seiber | 4/602 |
| 6,240,577 | B1 | | 6/2001 | Worthy | |
| 6,295,663 | B1 | * | 10/2001 | Haller et al. | 4/603 |
| 6,381,769 | B1 | | 5/2002 | Lofquist, Jr. | |
| 6,735,792 | B2 | | 5/2004 | Johansson | |
| 6,802,088 | B1 | | 10/2004 | Gruner | |
| 6,842,919 | B2 | * | 1/2005 | Wilson et al. | 4/578.1 |
| 6,912,740 | B2 | | 7/2005 | Fainberg | |
| 7,111,335 | B2 | | 9/2006 | Noro et al. | |
| 7,231,673 | B1 | | 6/2007 | Arnold et al. | |
| 7,506,385 | B2 | | 3/2009 | Werschmidt | |
| 8,091,158 | B2 | * | 1/2012 | Sato et al. | 4/611 |
| 2004/0238007 | A1 | * | 12/2004 | Jones et al. | 134/21 |
| 2005/0006500 | A1 | * | 1/2005 | Rosenberg | 239/536 |
| 2007/0033729 | A1 | * | 2/2007 | Faux | 4/601 |
| 2007/0266491 | A1 | * | 11/2007 | Gann | 4/613 |
| 2008/0196154 | A1 | * | 8/2008 | Felmeri | 4/579 |

* cited by examiner

*Primary Examiner* — Gregory Huson
*Assistant Examiner* — Christine Skubinna
(74) *Attorney, Agent, or Firm* — Nixon & Vanderhye P.C.

(57) ABSTRACT

Certain example embodiments of this invention relate to systems and/or methods that help clean persons having reduced mobility. The systems and/or methods of certain example embodiments help clean persons in areas that are difficult and sometimes even impossible to clean, thereby reducing the likelihood of infection, disease, development of antibiotic resistant diseases, etc. At least one showerhead is provided in such systems/methods. A chair, table, bench, or the like, has a seat and a back support. At least one bladder is connected to the seat and/or the back support of the chair, or on the table, bench, etc., with each said bladder having at least one opening. A hose connects a supply of cleansing fluid to the at least one bladder such that, in operation, the cleansing fluid is forced out of the at least one opening of each said bladder towards the person.

20 Claims, 6 Drawing Sheets

CLEANING SYSTEMS AND/OR METHODS

FIELD OF THE INVENTION

Certain example embodiments of this invention relate to cleaning systems and/or methods. More particularly, certain example embodiments of this invention relate to systems and/or methods that help clean persons having reduced mobility. The systems and/or methods of certain example embodiments help clean persons in areas that are difficult and sometimes even impossible to clean, thereby reducing the likelihood of infection, disease, development of antibiotic resistant diseases, etc.

BACKGROUND AND SUMMARY OF EXAMPLE EMBODIMENTS OF THE INVENTION

The dangers of staph and other infections diseases are well known. The recent outbreaks of MRSA are a reminder of how easily bacteria can spread and become increasingly problematic, especially when such bacteria become resistant to antibiotics. For example, the spread of MRSA is particularly problematic in hospitals, nursing homes, assisted/long-term care facilities, and the like, as patients with open wounds, invasive devices, and weakened immune systems tend to be at greater risk for infection than the general public. Hospital staff members who do not follow proper sanitary procedures may transfer bacteria from patient-to-patient. Visitors to patients with MRSA infections oftentimes are advised to follow hospital isolation protocols (e.g., which sometimes require gloves, gowns, and masks). Visitors who do not follow such protocols may sometimes spread bacteria elsewhere (e.g., to cafeterias, bathrooms, elevators, etc.). The U.S. Centers for Disease Control and Prevention (CDC) estimates that each year that there are nearly 2 million nosocomial (hospital-related) infections in U.S. hospitals, leading to nearly 100,000 deaths.

The spread of MRSA and other infections diseases oftentimes can be prevented or at least slowed. As alluded to above, following proper sanitary procedures can be extremely helpful. For most persons, "proper sanitary procedure" often involves thorough washings/cleanings.

Unfortunately, however, it frequently is difficult to provide through washings/cleanings to persons in hospitals, nursing homes, assisted/long-term care facilities, and the like. Many times, patients in such facilities rely on nursing staff members and/or others to wash them because they have reduced/limited mobility. Instead of simply taking a shower or bath, this procedure typically involves having a nurse or other staff member give a person a sponge bath or the like.

Although this process oftentimes is effective, further improvements are still possible and, indeed, desirable. For example, it oftentimes is difficult to thoroughly clean all areas of a person. Although not necessarily the fault of the caregivers, it has been found that hospital patients' backs, bottoms, legs, and other body parts, often are not adequately cleaned. These places may be impossible to reach by many patients themselves, and typically are difficult to reach for even experienced caregivers. Because these areas may not be adequately cleaned, bacteria may build-up, spread, become more resistant to antibacterial treatment, etc., thus unintentionally exacerbating the problems.

Thus, it will be appreciated that there is a need in the art for improved cleanings systems and/or methods that overcome some or all of these and/or other challenges.

In certain example embodiments of this invention, a system for cleansing a person is provided. At least one showerhead is provided. A chair has a seat and a back support. At least one bladder is connected to the seat and/or the back support of the chair, with each said bladder having at least one opening. A hose connects a supply of cleansing fluid to the at least one bladder such that, in operation, the cleansing fluid is forced out of the at least one opening of each said bladder towards the person.

In certain example embodiments of this invention, a system for cleansing a person is provided. At least one showerhead is provided. A bed or table also is provided. At least one bladder is connected to the bed or table, with each said bladder having at least one opening. A hose connects a supply of cleansing fluid to the at least one bladder such that, in operation, the cleansing fluid is forced out of the at least one opening of each said bladder towards the person.

In certain example embodiments of this invention, a system for cleansing a person is provided. At least one showerhead is provided. A structure in or on which a person is to sit or lie is provided. The structure includes a plurality of openings in the surface in or on which the person is to sit or lie. A hose connects a supply of cleansing fluid to the structure such that, in operation, the cleansing fluid is forced out of the plurality of openings towards the person.

In certain example embodiments of this invention, a method of cleansing a person is provided. The person is placed in a chair, bench, or bed, located in, or to be moved to, a cleansing room. Either (a) the person in the cleaning room is oriented, and/or (b) at least one showerhead of the cleansing room and/or at least one bladder connected to the chair, bench, or bed, is oriented, such that the at least one showerhead is arranged to provide cleansing fluid to at least an anterior region of the person and the at least one bladder is arranged to provide cleansing fluid to at least one posterior region of the person. Cleansing fluid is provided to the at least one showerhead and the at least one bladder in cleansing the person.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Certain example embodiments relate to systems and/or methods that help clean persons in areas that are difficult and sometimes even impossible to clean, thereby reducing the likelihood of infection, disease, development of antibiotic resistant diseases, etc. Such persons may be persons having reduced mobility, and/or persons who otherwise would typically rely on one or more caregivers for help in cleaning themselves.

Figure 1:
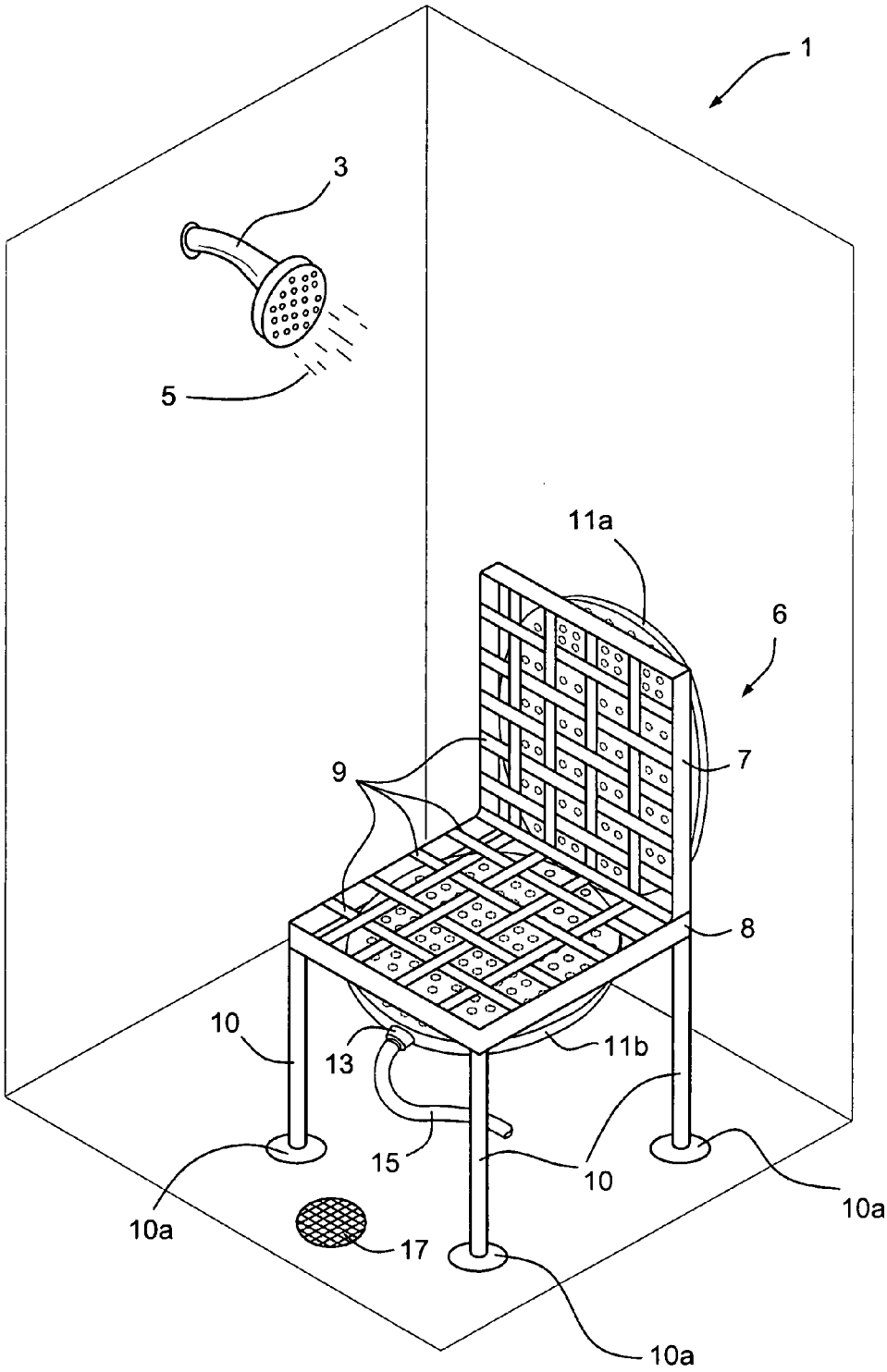
FIG. 1 is an overview of a system for cleaning persons having reduced mobility in accordance with certain example embodiments.

Referring now more particularly to the drawings, FIG. 1 is an overview of a system 1 for cleaning persons having reduced mobility in accordance with certain example embodiments. In certain example embodiments, some or all of the walls in the system 1 may be formed from glass, e.g., so that a caregiver is able to watch the person being cleaned (for safety and/or other reasons), so that the likelihood of bacteria spreading is reduced, etc. In certain example embodiments, some or all of the walls in the system 1 may be tiled, e.g., for privacy purposes. In certain example embodiments, some of the walls may be tiled and others may be formed from glass. Regardless of the particular material selected for the wall(s) of the system, an antibacterial coating may be provided to at least portions thereof.

The system 1 includes a showerhead 3, from which a cleansing fluid 5 is directed at a person placed in a seat 6. Multiple showerheads 3 may be provided in different example embodiments of this invention. Regardless of whether there is only one or there are multiple showerheads 3, they may be fixed or movable or, when multiple showerheads 3 are provided, some may be fixed while others are movable. When a movable showerhead 3 is incorporated into a system 1, it may be moved horizontally and/or vertically, e.g., so as to accommodate different persons. In certain example embodiments, the location of the showerhead 3 may be controlled by a caregiver from within or remote from the system 1. In certain other example embodiments, the person in the chair 6 may be able to grab and move the showerhead 3, e.g., via an arm (not shown), once it is lowered or otherwise put into the person's reach. The showerhead 3 may be responsible for cleaning the head, shoulders, lap, and front torso of the person, particularly when it is placed at position above the person. One or more additional showerheads may be located near the floor or ground so as to clean the person's legs, etc. It will be appreciated that the showerheads described herein may be rotatable and/or angleable so as to direct cleansing fluid to an appropriate area.

The seat 6 shown in FIG. 1 essentially is a chair with a back portion 7 and a bottom portion 8 that lacks arms. The back portion may be height, incline, and/or otherwise adjustable, for example, to help make a broader number of persons feel more comfortable while seated in the seat 6. Multiple slats 9 are provided to the back portion 7 and the bottom portion 8. These slats 9 support the person but also allow cleansing fluid from one or more bladders 11 (described in greater detail below) and/or other sources to reach the person. In place of, or in addition to, such slats 9, a plurality of holes may be provided at relevant locations. The seat 6 also includes a plurality of legs 10. The legs 10 also may be height adjustable to make a larger number of persons more comfortable. These legs may have stoppers 10*a* (e.g., made of rubber), so as to reduce the likelihood of the seat 6 moving, for example, as the person sits in the seat 6, during the cleaning, and/or as the person leaves from the seat 6. The seat 6 that is used in connection with the system may be formed from any suitable material such as, for example, stainless steel, a plastic or polymer material, a tempered glass or other ceramic material, etc. As above, regardless of the particular material selected for some or all portions of the seat 6, an antibacterial coating may be provided to at least portions thereof. In certain example embodiments, the seat 6 may be fully or partially padded, e.g., with a vinyl, plastic padding, or other padding, so as to increase comfort of the patient. Such pads may be provided as continuous cushions, strips over the slats, etc.

Different seats may be used in connection with different example embodiments. For example, a stationary or movable wheelchair may be provided in certain example embodiments. A movable wheelchair may be advantageous in certain example embodiments, as a person may be placed in the wheelchair outside of the system 1, moved into the system 1, put into place (with the showerhead(s) 3 optionally adjusted to desired locations), and moved out of the system 1 following the cleansing. Other chairs, benches, and/or the like also may be used in connection with certain example embodiments. Benches, with or without backs and/or arms, may be advantages in certain example embodiments, as a person may be "slid" from a wheelchair in which the person is transported onto the bench for cleaning in the system 1. In certain example embodiments, multiple bladders may be provided at substantially regular intervals along the bottom side of the bench.

As indicated above, one or more bladders 11 may be provided to the seat 6. As shown in the FIG. 1 example embodiment, first and second bladders 11*a* and 11*b* are connected to the back and bottom portions 7 and 8 of the seat, respectively. In certain example embodiments, a single, flexible bladder 11 may be provided so that it is similarly located. In certain example embodiments, multiple smaller and re-positionable bladders 11 may be provided, e.g., so as to potentially cover a broader number of areas. Additionally, or in the alternative, in example embodiments where arms are provided, one or more bladders 11 also may be provided thereto. It will be appreciated that the bladder 11*b* provided to the seat/bottom portion 8 may be provided underneath the seat/bottom portion 8, or on top of the seat/bottom portion 8. In the latter case, the bladder 11*b* may be provided in direct contact with the person sitting in the chair 6. Similarly, it will be appreciated that the bladder 11*a* provided to the back support 7 may be provided "behind" the chair 6, or on the other side. Again, in the latter case, the bladder 11*b* may be provided in direct contact with the person sitting in the chair 6.

Some or all of the bladders may have inlets 13. These inlets may be connected to a hose 15, through which a supply of cleansing fluid is provided. This cleansing may be forced through openings, holes, apertures, slits, and/or the like in the bladder(s) 11 so as to wash the person in the seat 6. The placement of the bladders 11 may be selected so as to provide cleansing fluids in those areas that typically are difficult to reach by the person and/or the caregiver, and/or those areas that typically are not adequately cleaned when attended to by the person or a caregiver. For example, in certain example embodiments, the bladders 11 may be provided at locations on the seat 6 and with reference to the slats 9 so as to clean some or all of the persons back, bottom, underarms, legs, back of legs, add/or other areas. Of course, more, fewer, and/or different locations also are possible in different embodiments of this invention.

Excess cleansing fluid from the showerhead(s) 3 and/or the bladder(s) 11 may be removed by virtue of one or more drains 17. Although the drain 17 in the FIG. 1 example embodiment is shown approximately in the center of the floor of the system 1, other positions, sizes, shapes, etc., also are possible. For example, in certain example embodiments, a larger, substantially rectangular drain may be provided proximate to where the person enters the system 1, e.g., so as to help reduce the amount of cleansing fluid exiting the system 1. In certain example embodiments, the floor may be gradually sloped towards such drains 17. Furthermore, certain example embodiments may provide a gradual slope leading into/out of the system 1, which may help to facilitate the drainage of cleansing fluids while also potentially making it easier to position a person in the system 1 (e.g., via a sort of gradual ramp).

A person may sometimes require oxygen or intravenous drips (e.g., of medication, food, etc.), be connected to monitors (e.g., heart-rate, pulse, breathing, and/or other monitors), etc. Although not shown in FIG. 1, certain example embodiments may help provide some or all of these to a patient. For example, a mask and tubing may be provided within the system 1 in certain example embodiments. An oxygen source connected to the tubing and mask may be provided, e.g., external to the system 1. A caregiver may place the person in the seat, place the mask over the person's face, and initiate the flow of oxygen from the oxygen source. When the person is done, the mask and/or tubing optionally may be discarded in certain example embodiments, to further improve sanitary conditions and/or to accommodate other persons who may be later using the system. Similarly, intravenous injection mechanisms and tubing may be provided within the system 1. The material(s) for intravenous injection also may be provided external to the system 1 in certain example embodiments. Finally, a variety of monitors, sensors, and/or the like may be provided within the system. In certain example embodiments, some or all of the computerized equipment may be provided external to the system 1 and/or behind protective casing so as to shield it in whole or in part from the cleansing fluids. In certain example embodiments, some or all of the monitoring equipment may be integral with the seat 6. For example, a pulse, blood flow, and/or other monitor may be integrated into a handlebar or chair arm so that the person need only grab onto this structure or insert a finger into an appropriate slot to provide the requisite signals to the analytical equipment.

Figure 2:
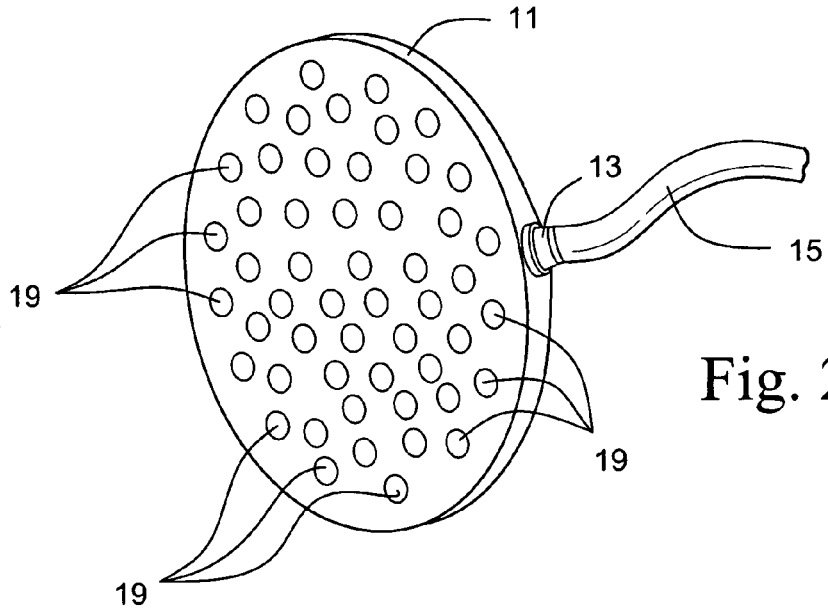
FIG. 2 is an illustrative bladder that may be used in connection with certain example embodiments.

FIG. 2 is an illustrative bladder 11 that may be used in connection with certain example embodiments. As indicated above, the bladder 11 includes a port 13 for connecting to the hose 15 and receiving cleaning fluids therefrom. The cleansing fluid, once received into the bladder 11, is then forced out of the bladder 11. In certain example embodiments, the cleansing fluid is forced out of the bladder 11 through one or more openings, holes, apertures, slits, and/or the like. These features may be sized and/or shaped so that pressure is built up within the bladder 11 so that the cleansing fluid exits with a greater force than that at which it is received into the bladder 11 by the port 13. Of course, the port 13 itself also may help increase the water pressure by being appropriately sized and/or shaped.

The bladders of certain example embodiments may be made from any suitable material such as, for example, plastic, rubber, etc. Deformable and/or otherwise adjustable materials may be used advantageously in certain example embodiments so as to the bladders may be more appropriately sized and/or shaped for a particular person in seat 6. For example, a deformable bladder may be made thinner and longer to better accommodate tall persons, whereas a deformable bladder may be made thicker and smaller for shorter persons. Of course, other possible deformations are possible. Additionally, bladders may be moved, replaced, supplemented, etc., in certain example embodiments. This may be accomplished in certain example embodiments by removably mounting the bladders to the seat 6, e.g., using hooks, snaps, or other appropriate fasteners. Of course, in different example embodiments, bladders may be more permanently mounted to various locations on seats 6.

In the FIG. 2 example embodiment, a plurality of small, generally circular holes 19 are provided on one side of the bladder 11. Of course, more or fewer holes 19 may be provided in different embodiments. Indeed, in certain example embodiments, a single slit may be formed in the bladder 11 through which the cleansing fluid may exit. In certain example embodiments, one or more openings may be formed on one or more sides of a bladder. This may be advantageous in the bladder were to be placed in the person's armpits, between the persons, legs, etc., inasmuch as it would help clean multiple areas at the same time. In certain example embodiments, some or all of the holes 19 may be plugged or otherwise "turned off." Thus, it may be possible to at least partially control where the cleansing fluid is directed in certain example embodiments. In certain example embodiments, the bladder may be provided over the entire seat, back support, or both the seat and back support.

Figure 3:
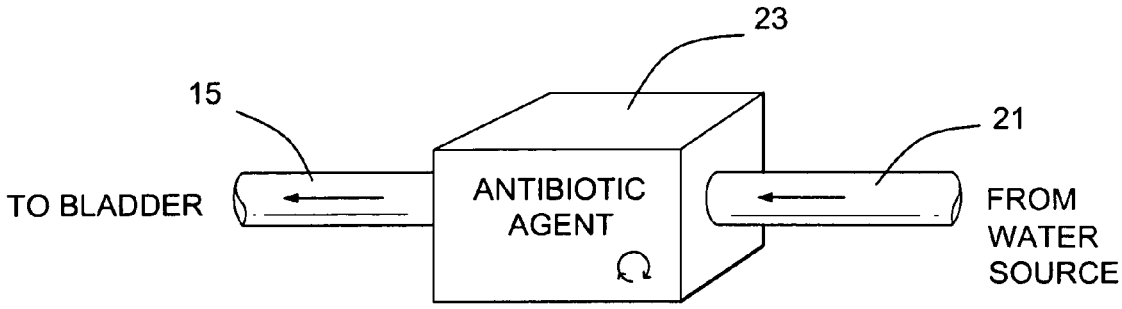
FIG. 3 is a partial schematic view of an illustrative portion of the system shown in FIG. 1 that may be used to provide a cleansing fluid to a person having reduced mobility in connection with certain example embodiments.
Figure 4:
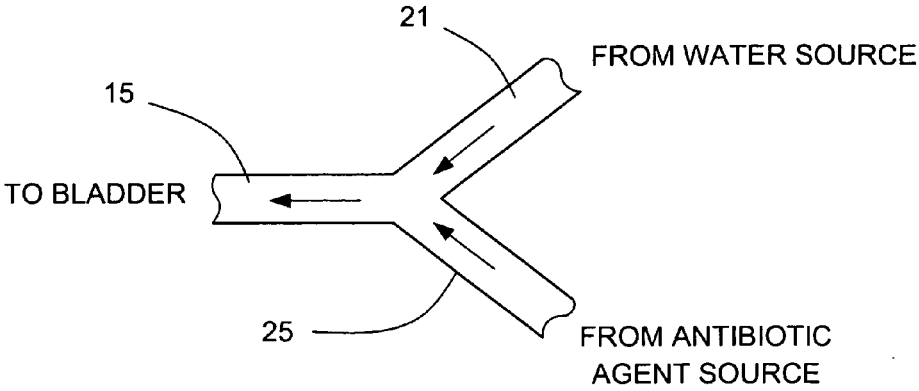
FIG. 4 is another partial schematic view of an illustrative portion of the system shown in FIG. 1 that may be used to provide a cleansing fluid to a person having reduced mobility in connection with certain example embodiments.

The cleansing fluid of certain example embodiments may comprise a mixture of water together with soap, antibacterial solution, antimicrobial solution, and/or other material. A liquid antibiotic agent also may be incorporated into the cleansing fluid. This cleansing fluid may be preformed and provided to the hose 15 and/or the showerhead 3 in certain example embodiments. Alternatively, the cleansing fluid may be prepared substantially "on-demand," e.g., just before or as a person is being cleaned. FIGS. 3 and 4 illustrate two example techniques for forming cleansing fluid in these and/or other ways.

FIG. 3 is a partial schematic view of an illustrative portion of the system shown in FIG. 1 that may be used to provide a cleansing fluid to a person having reduced mobility in connection with certain example embodiments. Water form a water source is provided via, a first tube or hose 21, to a supply of soap, antibacterial solution, antimicrobial solution, antibiotic agent, or other material, provided in a container 23. The water and the material in the container 23 are then mixed. In certain example embodiments, the mixing may be "passive" in that the water may "pick up" the appropriate agent in the container 23 as it moves therethrough en route to the hose 15 (and ultimately the bladder 11 and/or the showerhead 3). However, in certain example embodiments, "active" mixing, using some mixing mechanism (not shown), may take place in the container 23 so as to form the cleansing fluid. A monitor (also not shown) may indicate when the agent in the container 23 is running low so that additional agent may be added, so that the container 23 may be completely replaced, etc.

FIG. 4 is another partial schematic view of an illustrative portion of the system shown in FIG. 1 that may be used to provide a cleansing fluid to a person having reduced mobility in connection with certain example embodiments. Similar to the FIG. 3 example embodiment, water form a water source is provided via a first tube or hose 21. An agent also is provided via a tube or hose 25. These two tubes or hoses are funneled together so that the resulting mixture is provided to the hose 15 en route to the bladder 11 and/or the showerhead 3. The respective flow rates of the water and the agent may be adjusted so that an appropriate mixture is created by the time the materials are funneled together so that the resulting mixture includes the appropriate amounts of each.

Figure 5:
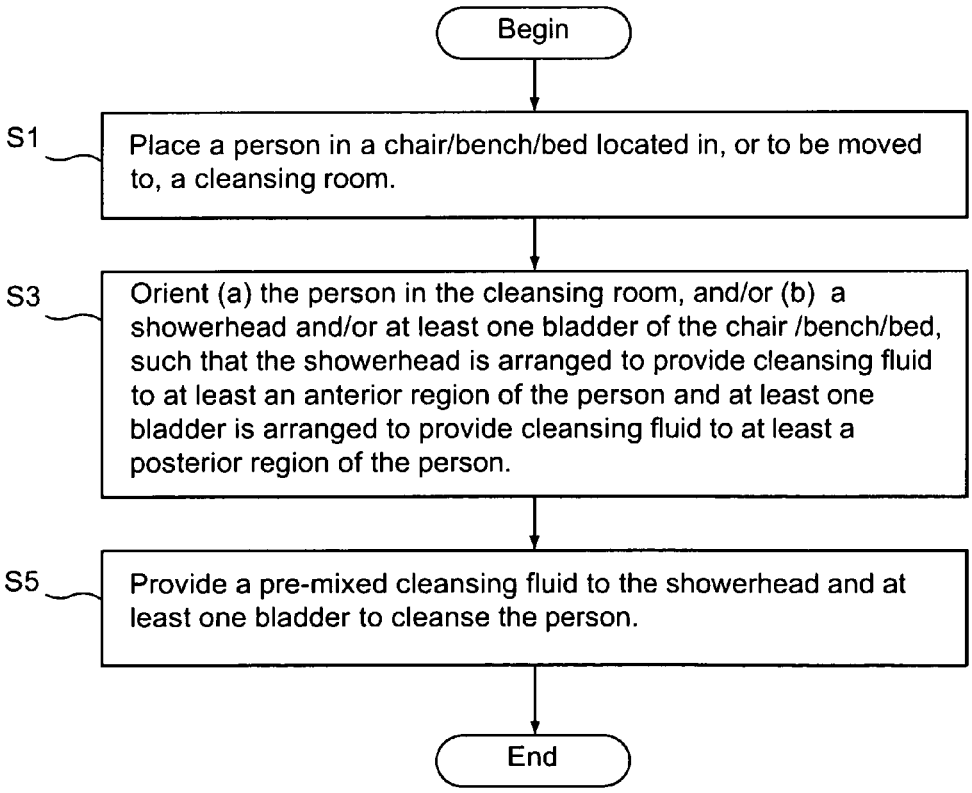
FIG. 5 is a flowchart illustrating an illustrative process for using the cleansing system of FIG. 1 in accordance with certain example embodiments.

FIG. 5 is a flowchart illustrating an illustrative process for using the cleansing system of FIG. 1 in accordance with certain example embodiments. In step 51, a person is placed in a chair, bench, bed, or other support structure that is already located in, or is to be moved to, a cleansing room. In step 53, the person is oriented in the cleansing room, and/or a showerhead of the cleansing room and/or at least bladder provided to the chair, bench, bed, or other support structure is oriented. This is done such that the showerhead is arranged to provide cleansing fluid to at least an anterior region of the person, and such that the at least one bladder is arranged to provide cleansing fluid to at least a poster region of the person. In step 55, a pre-mixed cleansing fluid is provided to the showerhead and the at least one bladder to cleanse the person. Of course, if the person is face down instead of face up, the bladder will provide cleansing fluid to at least an anterior region of the person, and the showerhead will provide cleansing fluid to at least a posterior region of the person.

Certain example embodiments have referred to systems that may be used in hospitals, nursing homes, assisted/long-term care facilities, and/or the like. Of course, the techniques described herein may also be used in other locations such as, for example, private individual or group homes, etc. Furthermore, the systems of certain example embodiments need not be custom designed and built. For example, the systems of certain example embodiments may be retrofitted into an existing shower and/or bathroom. In such cases, a suitable seat, bench, bed, wheelchair, etc., may be supplied with one or more bladders in one or more appropriate locations. Those bladders may be connected to a hose feeding from the same water source as a showerhead, faucet, etc., and/or those bladders may be connected to an auxiliary water source. The cleansing fluid may be formed, e.g., using the above-described and/or other techniques. Thus, it will be appreciated that the example systems described herein may be used in a wide variety of settings.

Although certain example embodiments have been described as relating to seats, chairs, wheelchairs, benches, and/or the like, other structures in which a person can sit and/or lay on also may be used in connection with certain example embodiments of this invention. For example, certain example embodiments may incorporate stretchers, beds, and/or the like. These other structures on which a person can sit and/or lay may be formed from the same and/or similar materials as those identified above. The same and/or similar bladders also may be used in connection with such structures. For instance, certain example embodiments may incorporate one or more bladders along the under-side of a stainless steel stretcher or bed so as to provide cleansing fluids along all, substantially all, or selected portions of a person's posterior regions.

Figure 6:
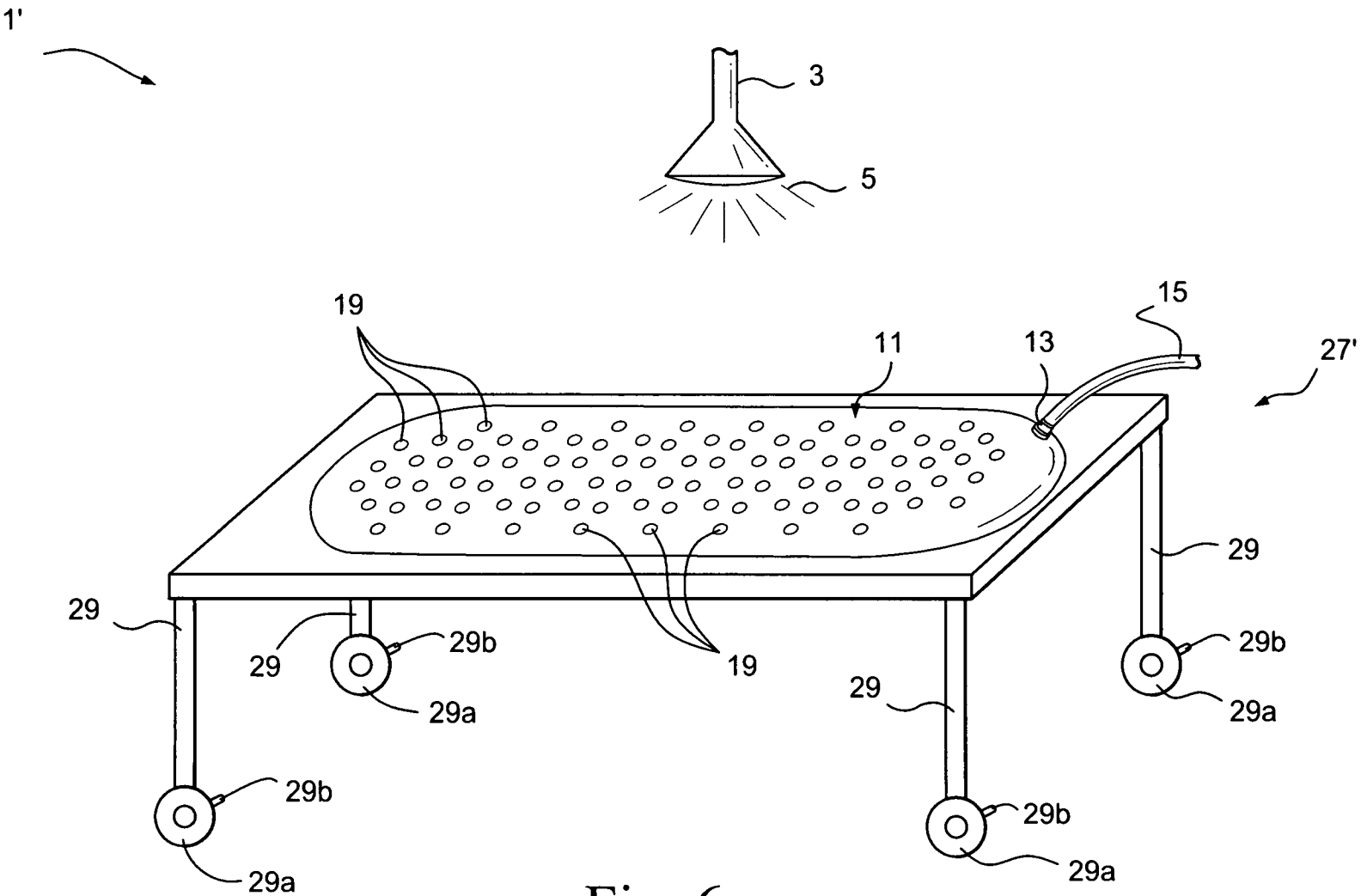
FIG. 6 is an overview of another system for cleaning persons having reduced mobility in accordance with certain example embodiments.

For example, FIG. 6 is an overview of another system 1' for cleaning persons having reduced mobility in accordance with certain example embodiments. The system 1' of FIG. 6 is similar to the system 1 in the FIG. 1 example embodiment, except that the FIG. 6 example embodiment includes a table 27. The table 27 includes a plurality of legs 27. These legs optionally include wheels 29*a* and locking mechanisms 29*b* that restrict the turning of the wheels 29*a*.

The table 27, like the chair 6 in the FIG. 1 example embodiment, has at least one bladder 11 connected thereto. Although the bladder is shown on the upper surface of the table 27 (e.g., so that it may directly contact the person on the table 27), it will be appreciated that the bladder 11 may be provided on the underside of the table 27 (e.g., so that it is more remote from the person). If the person is "face-up" on the table 27, then the at least one showerhead 3 will provide cleansing fluid to the anterior side of the person and the bladder 11 will provide cleansing fluid to the posterior side of the person. Of course, if the person is "face-down" on the table 27, then the at least one showerhead 3 will provide cleansing fluid to the posterior side of the person and the bladder 11 will provide cleansing fluid to the anterior side of the person.

Although certain example embodiments have been described in connection with bladders, other water deliver mechanisms may be used in place of, or in addition to, such bladders. For example, the chair, bench, bed, etc., itself may be structured to receive one or more sources of cleansing fluid. The cleansing fluid provided to that structure may then be forced out of holes formed therein. In certain example embodiments, one tube may be provided for each hole or a predefined group of holes. In certain example embodiments, the interior of the structure and/or separate structure may be designed to distribute cleansing fluids substantially evenly to all such holes.

Although certain example embodiments are described as relating to systems that help clean persons with reduced mobility, the present invention is not so limited. For example, certain example embodiments may be provided for amputees, aged persons, infirmed persons, etc. Moreover, certain example embodiments may be used for persons with reduced mobility, notwithstanding the particular cause(s) for the reduced mobility.

Figure 7:
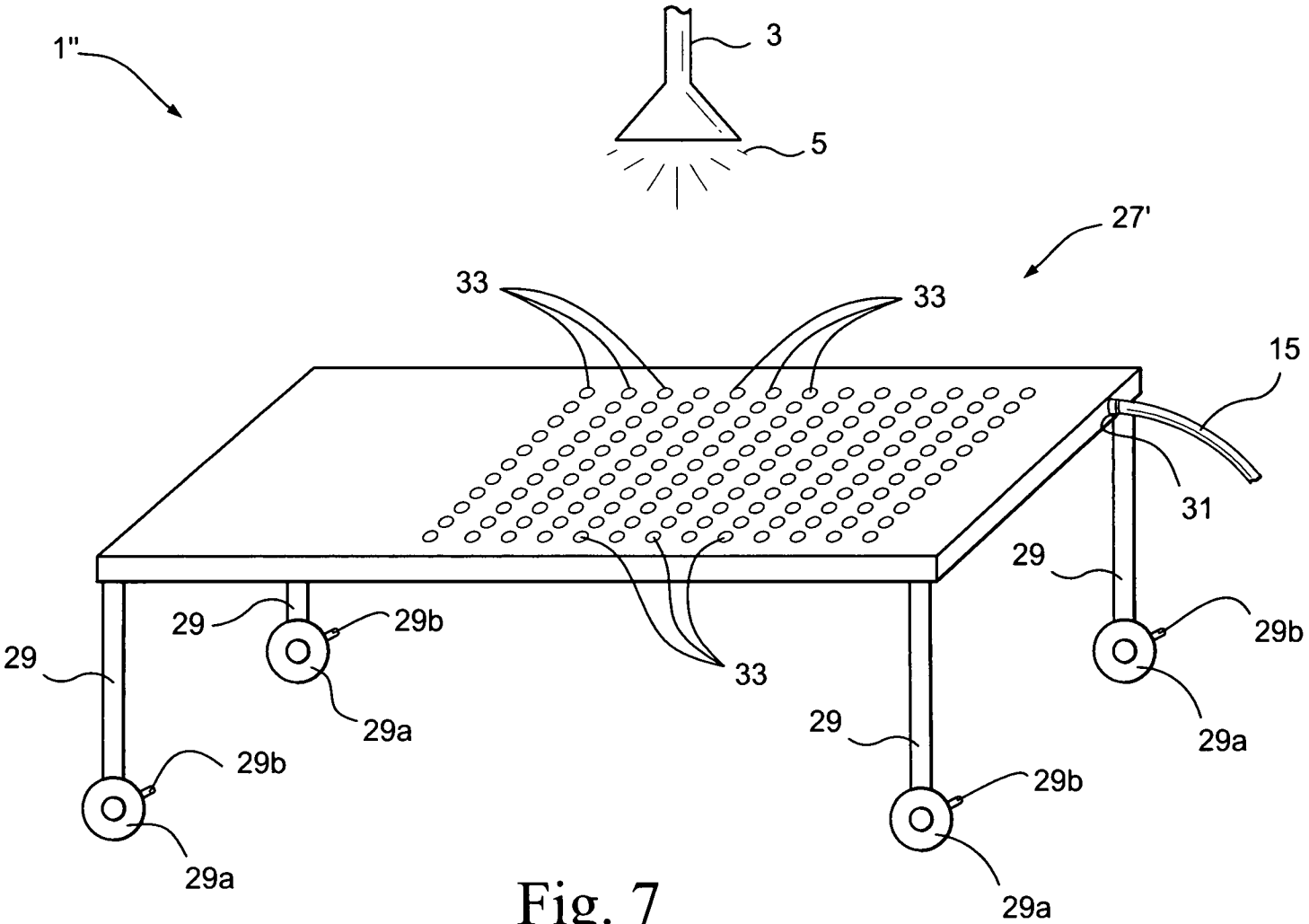
FIG. 7 is an overview of still another system for cleaning persons having reduced mobility in accordance with certain example embodiments.

In certain example embodiments, a cleansing system may include at least one showerhead and a structure in or on which a person is to sit or lie. This structure may include a plurality of openings in the surface in or on which the person is to sit or lie. A hose may connect a supply of cleansing fluid to the structure such that, in operation, the cleansing fluid is forced out of the plurality of openings towards the person. The openings may be selectively blocked in certain example embodiments, e.g., by plugging, covering with or inserting a sheet or resilient material, adjusting dials, and/or the like. Such an example system is shown in FIG. 7, which is an overview of still another system 1" for cleaning persons having reduced mobility in accordance with certain example embodiments. It will be appreciated that although the FIG. 7 example embodiment is shown as a table/bench, the same principles may be applied to a chair, wheel chair, etc. In FIG. 7, the table 27' has a plurality of openings 33 formed therein. These openings receive cleansing fluid from the hose 15 by virtue of an inlet port 31. Aside from lacking a bladder and having holes formed therein, the system 1" and the table 27' are similar to the system 1' and table 27 shown in and described in connection with the FIG. 6 example embodiment. Of course, in certain example embodiments, one or more showerheads may simply provide cleansing fluid through the holes without being directed connected to the chair, wheel chair, bench, etc.

Figure 8:
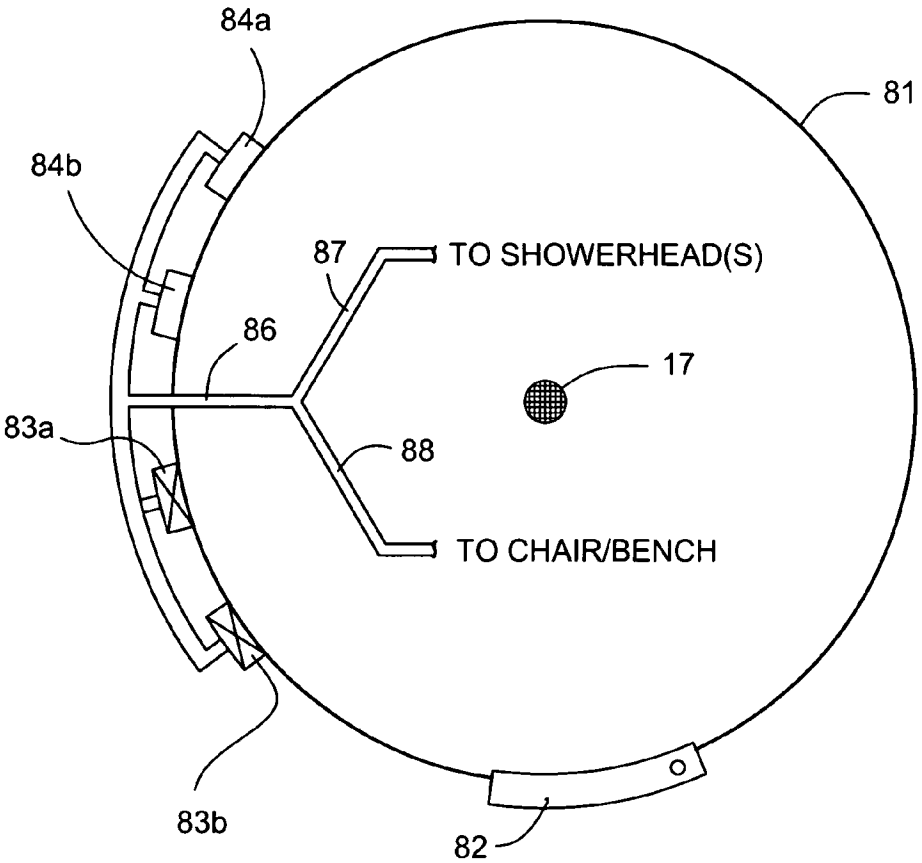
FIG. 8 is a top, schematic view of an illustrative portion of the system shown in FIG. 1 that may be used to provide a cleansing fluid to a person having reduced mobility in connection with certain example embodiments.

FIG. 8 is a top, schematic view of an illustrative portion of the system shown in FIG. 1 that may be used to provide a cleansing fluid to a person having reduced mobility in connection with certain example embodiments. The enclosure 81 includes a door 82. The enclosure 81 and/or the door 82 may be made of glass in certain example embodiments. Hot and cold water sources 83*a* and 83*b* may be connected to an injection system 86. This injection system 86 may include piping that splits, for example, along a first path 87 so as to provide cleansing fluid to the showerhead(s), and/or along a second path 88 so as to provide cleansing fluid to the chair, wheel chair, bench, etc. A soap dispenser 84*a* and/or an antibacterial agent/chemical source 84*b* also may be connected to injection system 86. The hot and cold water sources 83*a* and 83*b* may be combined with the soap dispenser 84*a* and/or an antibacterial agent/chemical source 84*b* so as to prepare a cleansing fluid for the patient.

In certain example embodiments, the soap dispenser 84*a* may be used for cleansing the person, whereas the antibacterial agent/chemical source 84*b* may be used for cleaning the enclosure itself. For instance, in certain example embodiments, the soap dispenser 84*a* may contain an antibacterial soap to be mixed with water from the hot and cold water sources 83*a* and 83*b* for cleansing the patient, whereas the antibacterial agent/chemical source 84*b* may contain a bleaching or other chemical cleansing element not suitable for cleansing persons but suitable for cleansing the enclosure 81 itself. This sanitization feature may be enabled by having an authorized user press a button external to the enclosure, e.g., when the enclosure 81 is vacant.

Figure 9:
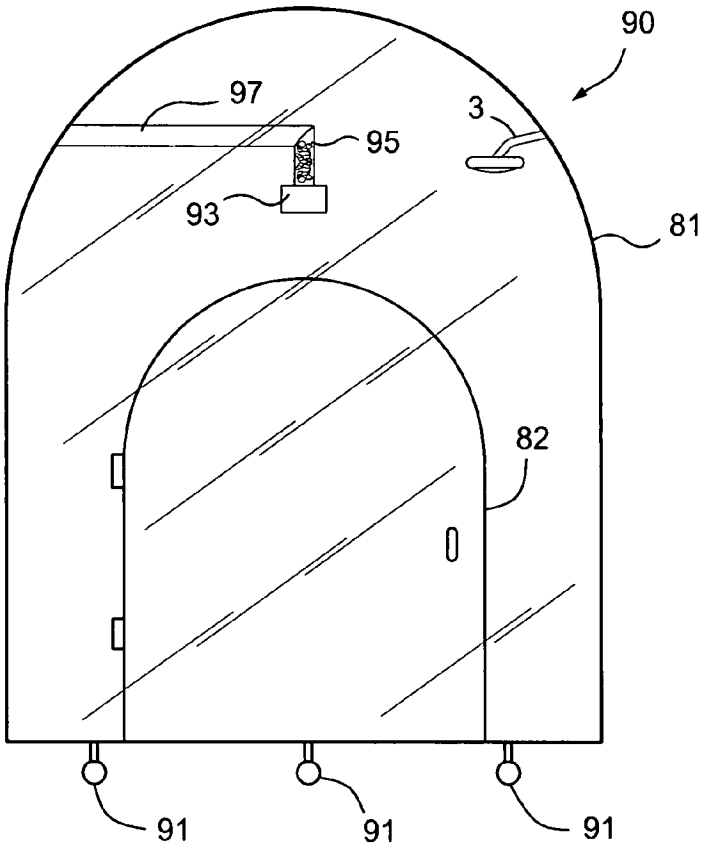
FIG. 9 is a schematic view of a mobile system that may be used to provide a cleansing fluid to a person having reduced mobility in connection with certain example embodiments.

In certain example embodiments, the cleansing system may be mobile or fixed in a "permanent" location. As one example, FIG. 9 is a schematic view of a mobile system 90 that may be used to provide a cleansing fluid to a person having reduced mobility in connection with certain example embodiments. The mobile system 90 may be similar to systems shown in FIGS. 1-8 and described above, although it may include a plurality of wheels 91 or other features that allow it to be moved more easily as compared to a fixed or "permanent" cleansing system. As such, FIG. 9 shows a glass enclosure 81 and a glass door 82, along with a showerhead 3. A mask 93 also is provided and receives a supply of breathable gas from a conduit 97. Optionally, the mask 93 may be connected to the conduit 97 via a retractable or otherwise adjustable connection 95, e.g., so that the mask may be raised or lowered to the suit the person in the enclosure 81. The breathable gas provided to the mask 93 may be pure oxygen, or a mixture of oxygen and other gasses, as appropriate or advisable, e.g., from a medical viewpoint. The mask 93 also may help reduce the likelihood of choking on the part of the person being cleansed.

It will be appreciated that the cleansing fluids provided to the showerhead(s) and the bladders may be the same or different cleansing fluids. For example, pure water may be provided to one, whereas a mixture of water and a cleansing agent may be provided to the other.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A system for cleansing a person, comprising:

at least one showerhead;

a chair having a seat and a back support;

at least one deformable bladder removably connected to the seat or the back support of the chair, said bladder having at least one opening;

a hose connecting a supply of cleansing fluid to the at least one bladder such that, in operation, the cleansing fluid is forced out of the at least one opening of each said bladder towards the person, wherein the chair further comprises a plurality of holes in the seat and back support through which, cleansing fluid is received from the at least one opening.

2. The system of claim 1, comprising a first bladder connected to the seat, and a second bladder connected to the back support.

3. The system of claim 1, wherein the cleansing fluid comprises soap and water.

4. The system of claim 1, wherein the chair is formed from stainless steel.

5. The system of claim 1, further comprising a plurality of walls, at least one said wall being made of glass.

6. The system of claim 1, further comprising at least one drain.

7. The system of claim 1, wherein the cleansing fluid is forced out of the at least one opening of said bladder with a greater pressure than a pressure at which it is received.

8. The system of claim 1, wherein the hose is removably connected to the bladder.

9. The system of claim 1, comprising a first bladder and a second bladder, wherein a size of the first bladder is different from a size of the second bladder.

10. The system of claim 1, comprising a first bladder and a second bladder, wherein a shape of the first bladder is different from a shape of the second bladder.

11. The system of claim 1, wherein the at least one opening of said bladder comprises a first opening on a first side of said bladder and a second opening on a second side of said bladder opposite the first side.

12. The system of claim 1, wherein said bladder is deformable in at least two directions.

13. The system of claim 1, wherein said bladder comprises rubber.

14. The system of claim 1, wherein the seat or the back support of the chair further comprises two or more attachment points configured to support the at least one bladder.

15. The system of claim 1, wherein the opening is selectively blockable.

16. The system of claim 5, wherein the walls form an enclosure in which the chair is situated.

17. The system of claim 1, wherein the system is mobile.

18. The system of claim 1, further comprising tubing configured to deliver medication to the person.

19. The system of claim 1, further comprising at least one sensor connectable to the person, the sensor providing signals indicative of a health-related status of the person.

20. The system of claim 1, further comprising any one or more of:

(a) tubing configured to deliver medication to the person;

(b) at least one sensor connectable to the person, the sensor providing signals indicative of a health-related status of the person.

* * * * *